United States Patent [19]

Haab

[11] 4,428,175

[45] Jan. 31, 1984

[54] ENERGY FREE LOADER

[75] Inventor: Gordon W. Haab, Richmond, Va.

[73] Assignee: G. W. Haab Co., Inc., Richmond, Va.

[21] Appl. No.: 388,895

[22] Filed: Jun. 16, 1982

[51] Int. Cl.[3] ..... B65B 5/10; B65B 21/16; B65B 43/62

[52] U.S. Cl. ..... 53/55; 53/69; 53/247; 53/251; 53/496

[58] Field of Search ..... 53/55, 58, 496, 495, 53/69, 74, 540, 251, 250, 249, 244, 247, 475, 473

[56] References Cited

U.S. PATENT DOCUMENTS

| | | | |
|---|---|---|---|
| 1,828,238 | 10/1931 | Andersen | 53/244 |
| 2,827,082 | 3/1958 | Baum | 53/55 |
| 3,332,200 | 7/1967 | Englander | 53/244 X |
| 3,410,046 | 11/1968 | Johnson | 53/496 |
| 3,486,296 | 12/1969 | Hechenleitner | 53/244 X |
| 3,512,336 | 5/1970 | Rosecrans | 53/244 X |
| 3,585,782 | 6/1971 | Staley | 53/244 X |
| 4,124,967 | 11/1978 | Beer et al. | 53/55 X |
| 4,291,519 | 9/1981 | Johnson | 53/244 X |

*Primary Examiner*—James F. Coan
*Attorney, Agent, or Firm*—John T. Roberts

[57] ABSTRACT

A case loader for articles in which the articles are received in a straight line extension from the article conveyor and in which they trip a first sensor when a case load is received, and the cases are directed to a loading station below and beside the article receiving station, the cases themselves tilted to receive the articles from an inclined chute the articles falling down the chute, the chute being arranged to reorient the bottles from a straight line into the rows and columns for the case, the case falling back onto the conveyor when filled and being removed from the case loader by the conveyor chain.

1 Claim, 10 Drawing Figures

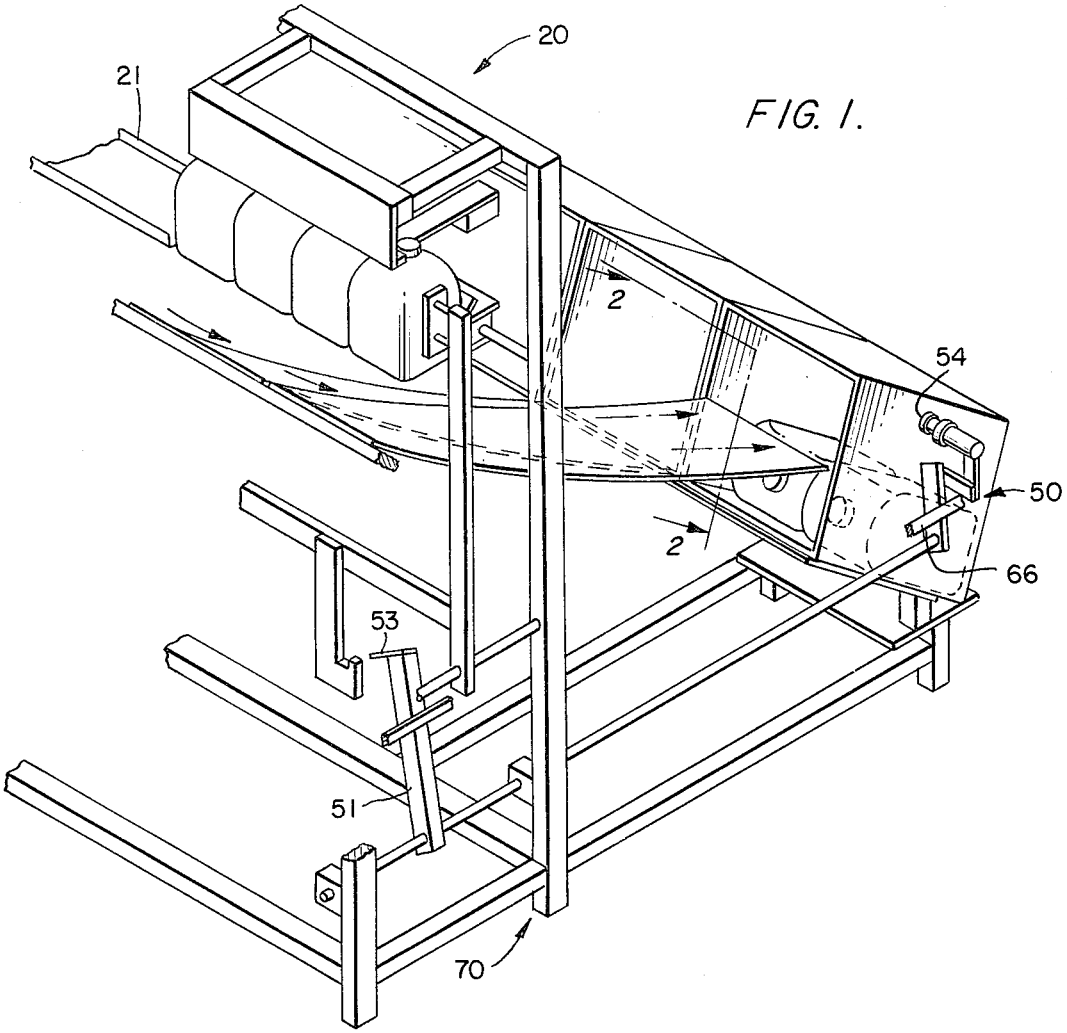
FIG. 1.
FIG. 2.
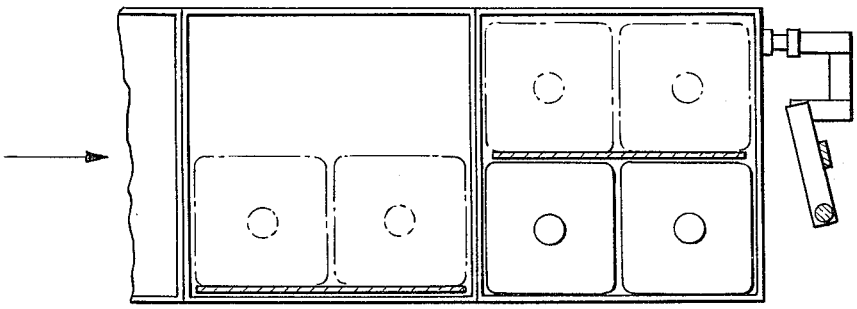

ENERGY FREE LOADER

CROSS-REFERENCE TO RELATED APPLICATION

This invention is disclosed in the co-pending application for patent of Joseph H. Burtoft, entitled "Energy Free Loader," filed June 4, 1982.

BACKGROUND OF THE INVENTION

1. Field of the Invention

The present invention relates to an apparatus and method for automatically loading cases with articles, and more particularly, relates to an improved apparatus and method in which the articles are bottles, cans or the like which are fed into the apparatus in continuous rows and are then loaded into the case in groups of rows and columns.

2. The Prior Art

Various methods and apparatus for loading articles in cases are known in the prior art. One type of apparatus assembles the articles in parallel rows of the length of the case by moving the required number of articles sideways off the article conveyor. When the proper number of columns are assembled, the entire caseload is dropped or lowered into the case.

Another method and apparatus is to load the case row by row. The loading apparatus picks up a row of the required length and puts it in the case and then returns to pick up the next row of the same length, placing it in the case beside the first row.

A third type of apparatus separates the articles into parallel columns as they are conveyed to the loading station. The articles at the lead position of each column are dropped into the case row by row. A variation of this is when the articles are round cans. They may be all slid into the case at the same time, the loading apparatus releasing an entire case load at once to roll into the case.

It is an object of this invention to eliminate the elaborate machinery required to assemble a caseload of articles and lower it into the case.

It is another object of this invention to eliminate the hydraulic and electric motors required to move and reorient the various articles while putting them in the case.

It is a further object of this invention to eliminate the manual placement of the case in a position to receive the articles or to eliminate the electric or hydraulic motors in the devices to move the carton from the conveyor to the loading station and then return it to the case conveyor when it is filled.

SUMMARY OF THE INVENTION

The energy free loader is fed bottles by a bottle conveyor. The bottles in the loader rest on a hinged ledge. When the number of bottles required to fill the carton is present in the loader, a first sensor is activated. The cases are conveyed to the loader below and beside the position of the bottles. The cases are tipped up and, when in place, they activate the second sensor. When both sensors are activated, the bottles drop and fall into a chute directing the bottles from the loading station and into the cases. The chutes reorient the bottles from a single line into the rows and columns required to fill the cases. The loader may fill one case entirely in one cycle, two cases half full on each cycle, or several cases partially full on each cycle. When the bottles have dropped, the ledge is reset to receive the next group of bottles. The force of the bottles tips the case back onto the conveyor and it is carried away.

BRIEF DESCRIPTION OF THE DRAWINGS

The invention will be better understood and the objects other than those set forth above will become apparent when consideration is given to the following detailed description thereof. Such description makes reference to the annexed drawings wherein:

FIG. 1 is a perspective view of the energy free loader with bottles on the ledge and cases in place ready to receive them;

FIG. 2 is a section on lines 2—2 of FIG. 1 looking toward the boxes;

DETAILED DESCRIPTION OF THE INVENTION

Figure 3:
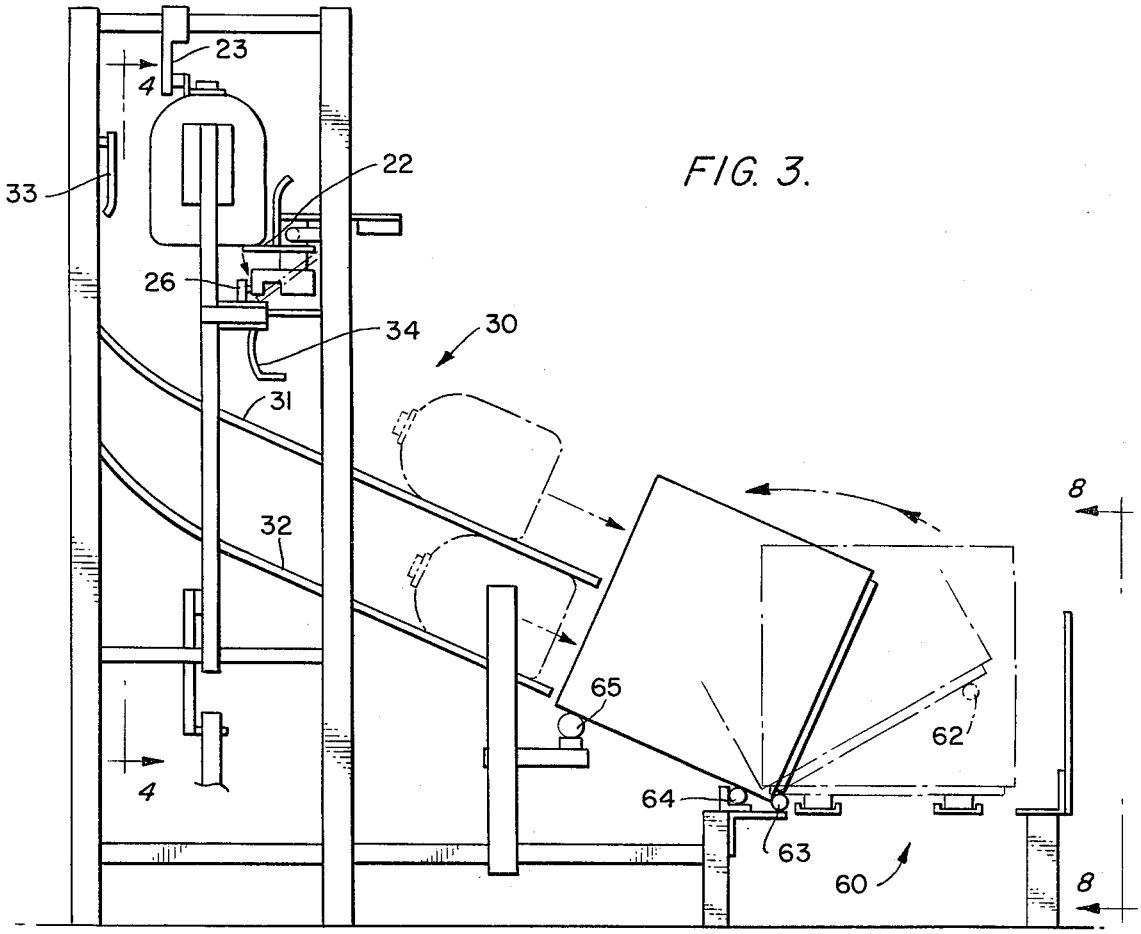
FIG. 3 is an end view of the energy free loader showing the bottles in solid line on the ledge and in dashed line about to enter the cases.
Figure 4:
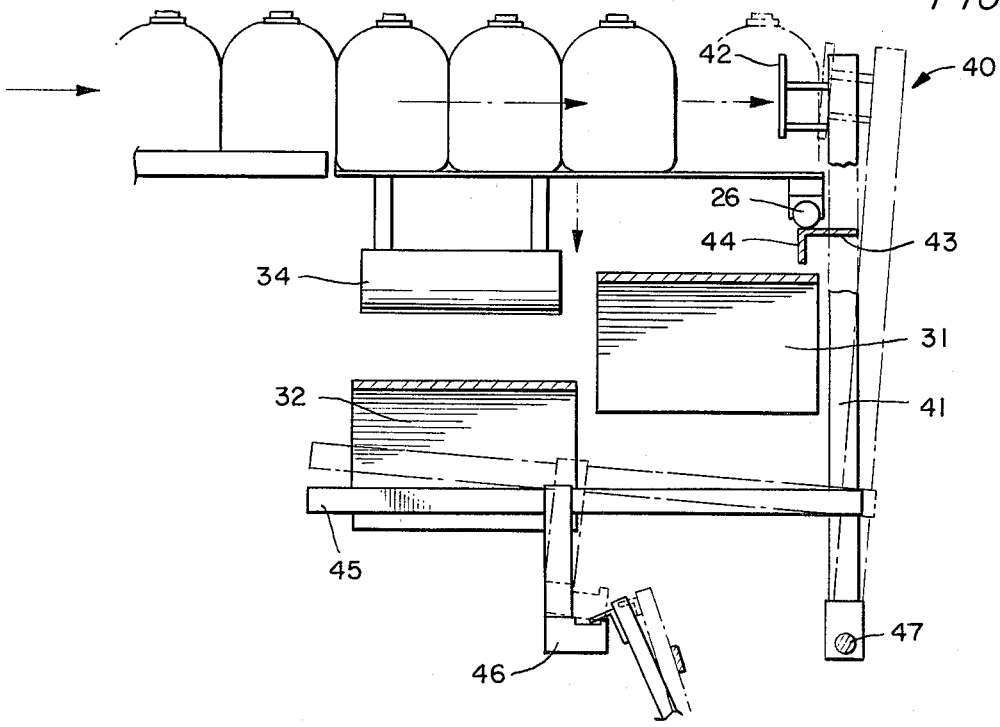
FIG. 4 is a cross-sectional view on lines 4—4 of FIG. 3 showing the untripped position in solid line and the tripped position in dashed lines.
Figure 4A:
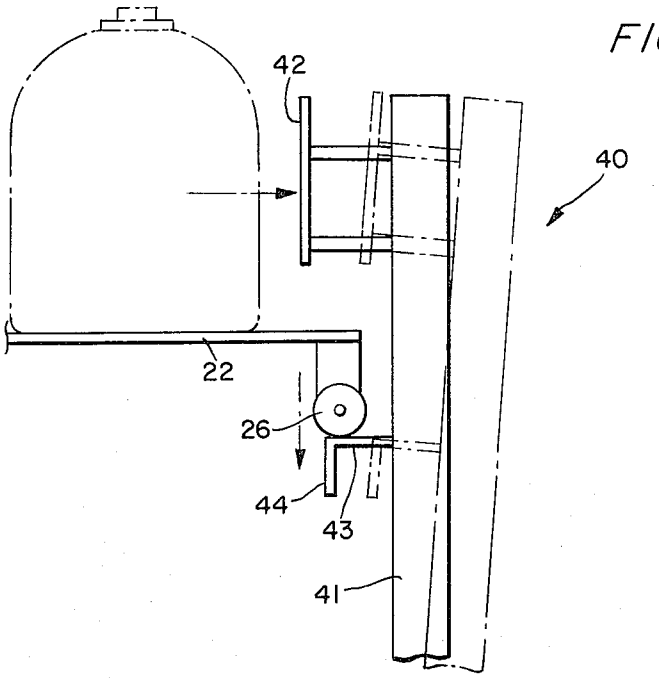
FIG. 4A is an enlarged view of the roller and roller support shown in FIG. 4.
Figure 8:
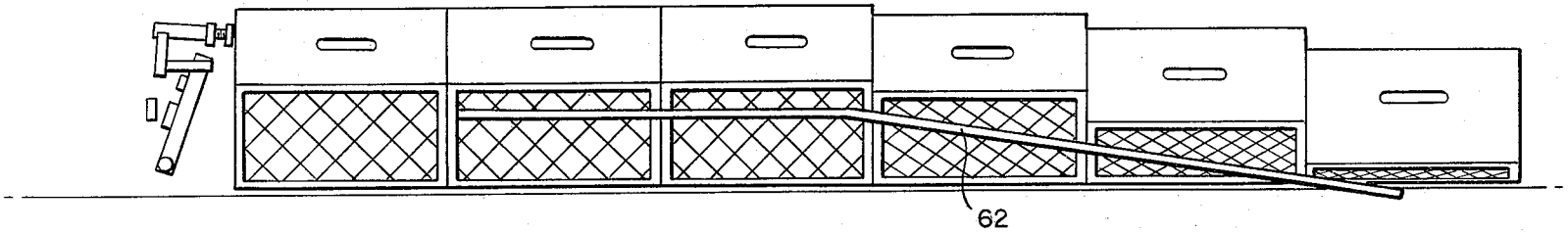
FIG. 8 is a front view of the energy free loader showing the boxes being tilted.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The energy-free loader comprises several principal systems. These are the bottle support system 20, the bottle guide system 30, the bottle sensor system 40, the case sensor system 50, and the case conveying system 60. All of these systems are attached to the main frame 70.

The bottle support system 20 is an extension of a conventional bottle conveyor such as a belt conveyor with end tray 21. The system includes a ledge 22 which extends from the belt conveyor for the length of four bottles in the system as shown. The ledge 22 has a vertical and horizontal plate and fits under and around one edge of the bottle. The bottles are urged onto the ledge 22 by the following bottles on the conveyor system. Each bottle is held upright in the bottle support system by plate 23 acting on the opposite side of the top of the bottle holding it in an upright position. Ledge 22 is attached to pivot 24 and counterbalanced by weight 25, holding the ledge in the horizontal position when fewer than four bottles are on the ledge. Attached to ledge 22 is roller 26, whose function is explained below.

Beneath the bottle support system is the bottle guide system 30. This includes an upper chute 31 for two bottles and a lower chute 32, also for two bottles. The upper chute begins below the right hand two bottles in FIG. 1 and ends in a position to make those two bottles the upper course in the right case as shown in FIG. 1. The lower chute begins below the left hand two bottles and ends in a position to make the lower course in the left case in FIG. 1. Behind the ledge and extending across the loader is bottle guide 33. Above the lower chute is flexible deflector 34. Not shown are suitable side guides which will prevent lateral or rotational movement of the bottles as they move down the chutes.

Bottle sensor system 40 detects when there are four bottles in the bottle support system 20. All of the bottles are urged along the ledge 22 by the following bottles on the bottle conveyor system. If, for some reason, there are missing bottles, it will take longer for the four bottles to be in place. When the four bottles are in place, the lead bottle presses on bottle stop 42 attached to lever arm 41 which is pivoted at 47. Below the lever arm 41 is roller support 43 on which rides roller 26. Depending below the roller support 43 is roller stop 44. Below the roller stop is horizontal lever arm 45 on which is attached case lever hook 46. Not shown is a stop which limits the movement of lever arm 41.

The case conveying system 60 includes a conventional conveyor chain. On the side of the conveyor away from the loader is inclined bar 62 which rises from beneath the conveyor and one side of the case to an elevation to tip the case towards the bottle support system. On the other side of the conveyor are side supports 63, 64, and 65 which hold the cases in the tipped position. The cases are prevented from moving further in the tipped position by case sensor system 50 and the end frame 66.

Case sensor system 50 contains case lever 51 which is pivoted at 52. The case lever arm 51 includes finger 53 which cooperates with the case lever hook 46. The case lever 51 is pivoted by the leading case being pushed into the final case loading position by following cases on the conveyor system. The case contacts case arm 54 which is also connected to pivot 52. The case arm 54 is prevented from further movement by end frame 66.

Mode of Operation

The bottles are continuously conveyed by the bottle conveyor across tray 21 to the bottle support system 20. The following bottles urge the four leading bottles to slide across ledge 22 and plate 23 until the lead bottle strikes bottle stop 42.

If a case is not in position to be loaded the case lever finger 53 prevents the lever arm 41 from moving and the four bottles remain on ledge 22, which is held in the horizontal position by roller 26 resting on roller support 43.

The cases are pushed along the case conveyor by the following cases. When the leading case strikes the inclined bar 62 it will tilt and rise above the conveyor, thus losing contact with the conveyor. It rests on inclined bar 62 and side supports 63 and 64 and is pushed forward by the following cases. As the case approaches the case loading position it has tilted beyond top dead center and is then supported entirely by side support 65 along the side and not bar 62. The inclined bar 62 does not extend to the final case loading position. The lead case strikes case arm 54 pushing it against end frame 66. The case need only move the case arm enough to allow finger 53 to disengage from case lever hook 46, thus allowing lever arm 41 to pivot freely.

When lever arm 41 pivots, the roller 26 falls off of roller support 43 thus pivoting ledge 22 to a vertical position and releasing the bottles. Each of the four bottles falls against bottle guide 33 and then into the chutes 31 and 32. The two bottles above the lower chute 32 first strike flexible deflector 34 which serves to guide them and to limit their velocity to guard against denting the bottles.

The two bottles which go through the lower chute to the trailing case form the lower course in that case. The two bottles which go through the leading case form the upper course in that case. Those two bottles have sufficient momentum to tilt the case, or pivot it around support bars 63 and 64 back onto the conveyor chain which removes the case from the loader.

Immediately after the bottles fall from the bottle support system the lever arm 41 will be biased back to its original position by the weight of lever arm 45. It is prevented from returning to that position because roller 26 is riding on roller stop 44. When the bottles have fallen below ledge 22, weight 25 will bias the ledge back to the horizontal position, thus bringing roller 26 back up above roller support 43 and allowing the feed-in lever to return to its original position.

Figure 9:
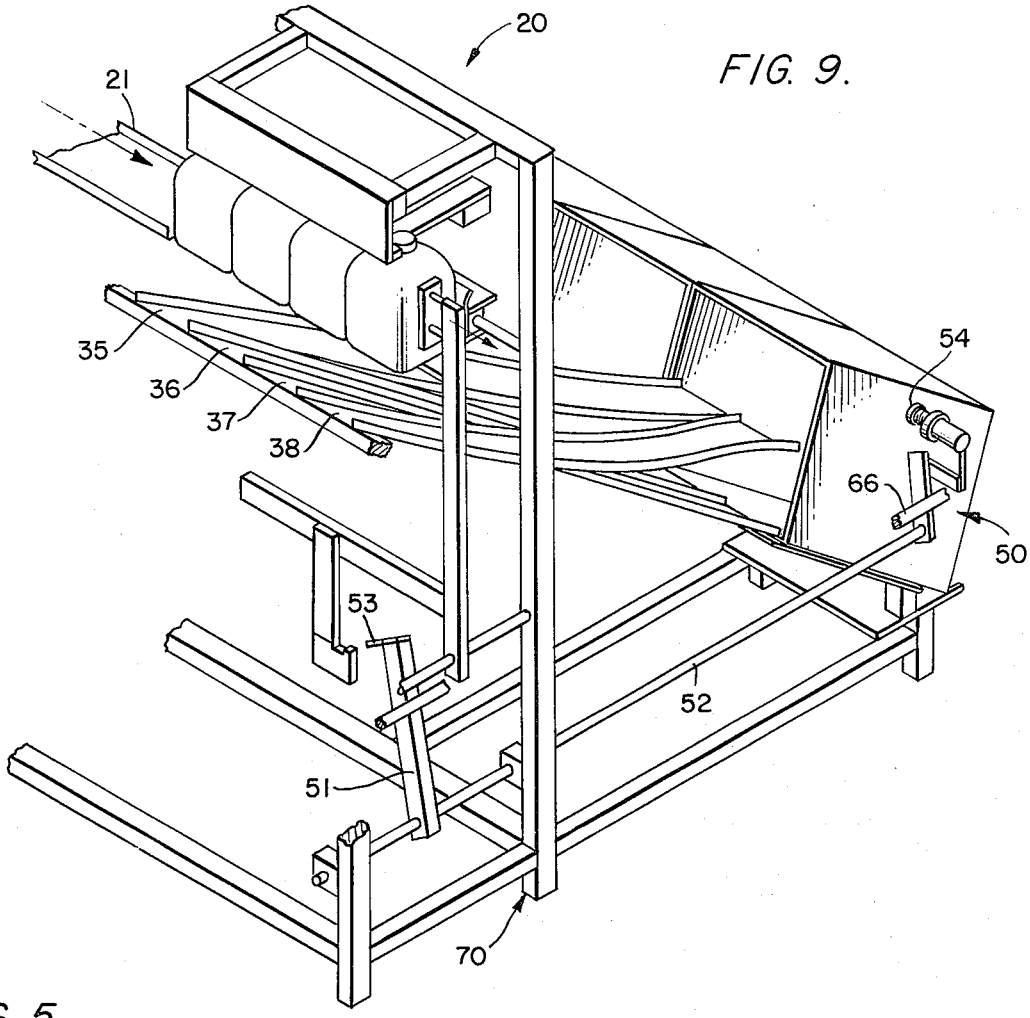
FIG. 9 is a perspective view of an alternate form of the energy free loader.
Figure 5:
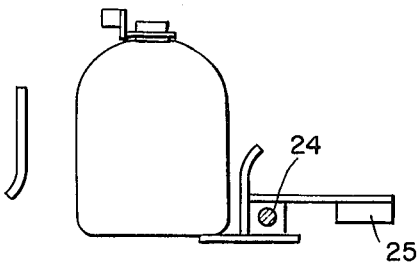
FIGS. 5, 6 and 7 show the bottle and pivoted ledge in the support, partially tripped, and fully tripped position.
Figure 6:
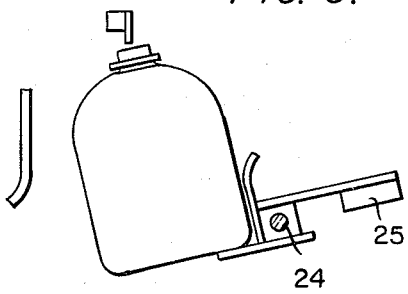
Figure 7:
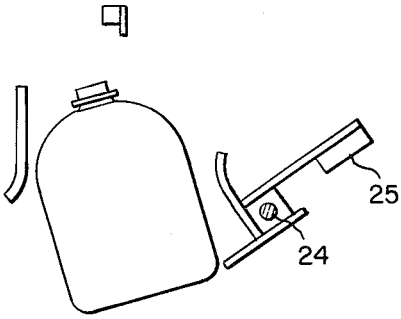

A second embodiment is shown in FIG. 9. The only difference is in the bottle guide system 30. This comprises four chutes or slides 35, 36, 37, and 38. The inner chutes, 36 and 37, are identical in design and guide those two bottles down and to one side when they are released by the support system. Outer chutes 35 and 38 are mirror images of each other, guiding the outer two bottles in a S-shaped route down and to one side and on top of the bottles in chutes 36 and 37. The two central bottles in chutes 36 and 37 fall directly into the lower position in the case. Because the chutes are shorter than chutes 35 and 38 those two bottles arrive into the case slightly ahead of the other two bottles which follow the S-shaped chutes 35 and 38 and become the top level in the case.

In this embodiment one case is entirely loaded in one cycle.

The loader could equally load a 3×3 case in one or three cycles or a 2×4 case in one, two or four cycles. The operation herein disclosed is applicable to cans or bottles or containers of various configurations.

Although the present invention has been described with reference to two particular embodiments thereof, it should be understood that those skilled in the art may make many other modifications and embodiments thereof which will fall within the spirit and scope of the principles of this invention.

What is claimed as new and desired to be secured by patent of the United States is:

1. In a case loader for containers comprising in combination:

(a) a container loading station for attachment to the end of a conveyor, said container loading station holding a case load of containers in a single column;

(b) a case loading station above a case conveyor for transporting cases to and away from the case loading station;

(c) said case loading station located beneath and to one side of the container loading station;

(d) a plurality of container slides between the bottom of the container loading station and the case loading station;

(e) said container slides each beginning at the position of different containers and each ending at different container positions at the case loading station;

(f) a first stop means to hold the column of containers in position when the case load of containers has been conveyed to the container loading station;

(g) an inclinded bar leading from beneath the case conveyor to above the case loading station to tilt the cases as they approach the case loading station;

(h) means to hold the case in a titled position at the case loading station;

(i) a second stop means to hold the container in the case loading station until it has been loaded with containers; the improvement comprising:

(j) a pivoted container support in the bottom of the container loading position, said support holding said containers when in the horizontal support position and allowing said containers to fall by gravity when in the released position;

(k) a counterweight biasing said container support into the support position, said counterweight being overcome by the weight of a case load of containers;

(l) said container support, when in the support position, resting upon a movable support plate, which in the first position holds said container support in the support position and in the second position allows said container support to pivot to said released position;

(m) a lever arm to which the support plate is attached, allowing said support plate to pivot from the first position to the second position;

(n) a counterweight biasing said lever arm to said first position;

(o) a mechanical container sensor in said case loading station, said mechanical container sensor being activated by the leading container when slid into its position by the other containers in the container loading station;

(p) said mechanical container sensor biasing said lever arm into the second position overcoming the counterweight;

(q) a latch connected to said lever arm preventing said lever arm from moving from the first position to the second position;

(r) a mechanical case sensor which is tripped when a case reaches the case loading station;

(s) said mechanical case sensor withdrawing said latch when the case is in position;

whereby, when both the containers and case are in position, the lever arm moves, the container support pivots, and the containers fall into the case.

* * * * *